US007477019B2

(12) United States Patent
Bardell et al.

(10) Patent No.: US 7,477,019 B2
(45) Date of Patent: Jan. 13, 2009

(54) ELECTRON BEAM TUBES

(75) Inventors: Stephen Bardell, Barnston (GB); Steven Aitken, Chelmsford (GB); Stuart William Andrews, Langham Colckester (GB); Neil O'Sullivan, Chelmsford (GB); Alan Edward Wheelhouse, Braintree (GB)

(73) Assignee: E2VV Technologies (UK) Limited, Essex (GB)

( * ) Notice: Subject to any disclaimer, the term of this patent is extended or adjusted under 35 U.S.C. 154(b) by 232 days.

(21) Appl. No.: 10/537,392

(22) PCT Filed: Dec. 2, 2003

(86) PCT No.: PCT/GB03/05199

§ 371 (c)(1),
(2), (4) Date: Dec. 16, 2005

(87) PCT Pub. No.: WO2004/051692

PCT Pub. Date: Jun. 17, 2004

(65) Prior Publication Data

US 2006/0152176 A1 Jul. 13, 2006

(30) Foreign Application Priority Data

Dec. 2, 2002 (GB) ..... 0228011.3

(51) Int. Cl.

*H01J 23/12* (2006.01)

(52) U.S. Cl. ..... 315/5; 315/5.51

(58) Field of Classification Search ..... 315/5, 315/5.38, 5.39, 5.51

See application file for complete search history.

(56) References Cited

U.S. PATENT DOCUMENTS

| | | | |
|---|---|---|---|
| 2,903,614 | A | 9/1959 | Hall |
| 3,111,600 | A | 11/1963 | Levin |
| 5,684,364 | A | 11/1997 | Heppinstall |

FOREIGN PATENT DOCUMENTS

| | | | |
|---|---|---|---|
| GB | 784742 | | 10/1957 |
| GB | 2 172 424 | A | 9/1986 |
| GB | 2 172 425 | | 9/1986 |
| GB | 2 278 720 | A | 12/1994 |
| GB | 2360125 | | 12/2001 |

*Primary Examiner*—Benny T. Lee
(74) *Attorney, Agent, or Firm*—Venable LLP; Robert Kinberg; Steve J. Schwarz

(57) ABSTRACT

An electron beam tube (17) having a longitudinal axis comprises a first component, such as a ceramic wall (5) and a second component such as a drift tube assembly having a mounting plate (3). The tube further comprises means, such as member (18), arranged to allow relative sliding movement of the first component relative to the second component in a radial direction. The invention helps to alleviate mechanical stresses caused by differential thermal expansion of the components.

12 Claims, 2 Drawing Sheets

ELECTRON BEAM TUBES

FIELD OF THE INVENTION

This invention relates to electron beam tubes, and particularly to linear beam devices.

BACKGROUND OF THE INVENTION

Linear beam devices are employed in order to amplify signals at high frequencies by modulating an electron beam.

Examples of such devices are klystrons and Inductive Output Tubes (IOTs). Such devices are typically employed as the final stage of amplification in television transmitters at frequencies within the UHF range (470 to 800 MHz). A typical linear beam device comprises an electron gun for generating a beam of electrons, an RF interaction region, for example a series of drift tubes, where amplification of an RF signal takes place and a collector for dissipating the electron beam after it has left the RF interaction region. Amplification of the signal takes place within a vacuum envelope.

Such devices may be of the so-called external cavity type, in which the vacuum envelope comprises a plurality of ceramic cylinders attached to metal structures, for example mounting plates provided on drift tube assemblies.

A problem that may be encountered with such devices is that changes in temperature in the device can give rise to mechanical stress between components of the tube.

It has been proposed to alleviate such problems by the inclusion of so-called balance rings, usually of ceramic, which reduce such thermal stresses. However, it has been found that, in certain conditions, even with the inclusion of balance rings, thermal stresses may be significant and may even cause damage to the ceramic walls defining the vacuum envelope.

SUMMARY OF THE INVENTION

The invention is defined in the claims to which reference is now directed.

The invention permits relative radial movement of components of the tube, in order to alleviate stress produced by differential thermal expansion between the components. The invention includes means arranged to produce relative sliding movement in the form of a member interposed between the components. This arrangement maintains the integrity of the vacuum envelope.

The member may be annular, in order to correspond to the shape of the walls defining the vacuum envelope.

Preferably, the member includes material arranged to reduce friction between the components.

In an embodiment, one of the components may include a portion of the ceramic wall forming part of the vacuum envelope. The other component may be part of a drift tube, such as the mounting plate.

BRIEF DESCRIPTION OF THE DRAWINGS

The invention will now be described, by way of example, with reference to the accompanying drawings, in which.

DETAILED DESCRIPTION OF A PREFERRED EMBODIMENT

Figure 1:
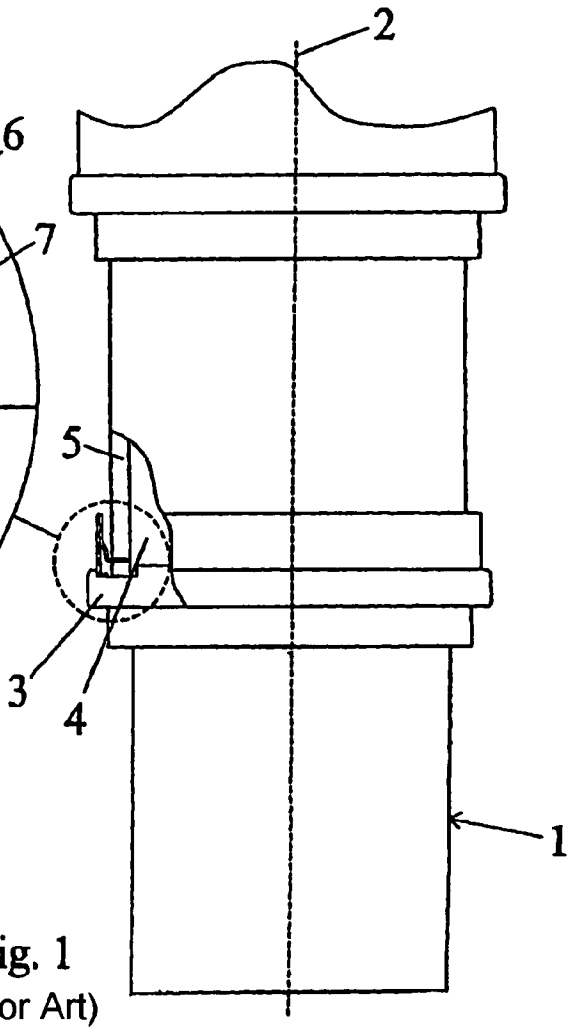
Fig. 1 (Prior Art)
FIG. 1: is a partly sectional schematic side view of a prior art electron beam tube.

Like reference numerals refer to like parts throughout the specification, and may not be described in detail in the different drawing figures.

Figure 1A:
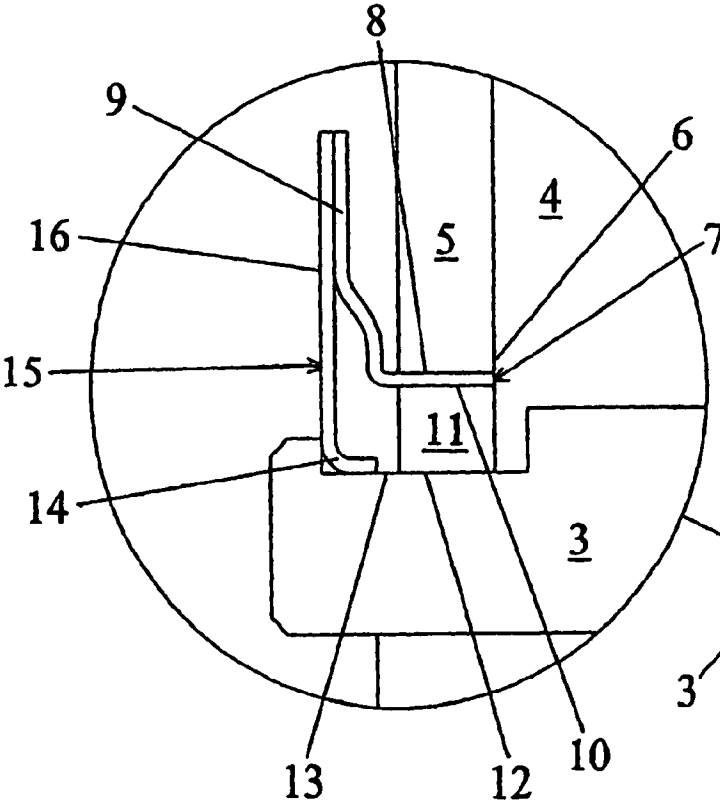
Fig. 1a (Prior Art)
FIG. 1*a:* illustrates in more detail the portion of FIG. 1 circled by a broken line.

FIGS. 1 and 1*a* illustrate part of a conventional electron beam tube, indicated generally in FIG. 1 by reference numeral 1, the tube having a longitudinal axis 2. The part illustrated in these Figures generally comprises the RF interaction region for the tube incorporating a drift tube assembly. Only one side of the tube is shown in detail in FIG. 1*a,* the components illustrated being approximately symmetrical about the longitudinal axis.

A mounting plate 3 for the drift tube is shown in FIG. 1*a.* The mounting plate is typically of copper, stainless steel or nickel. A vacuum envelope 4 for the tube is partially defined by a cylindrical wall of RF transparent material, such as alumina. The cylindrical wall 5 is substantially coaxial with the longitudinal axis 2. The mounting plate 3 also forms part of the vacuum envelope 4. The cylindrical wall 5 is attached to the drift tube mounting plate 3 in the following manner.

An end surface 6 of the wall 5 is metallised and attached by brazing to a flare 7, which is of metallic material such as cupro-nickel. The flare 7 has a portion 8 that abuts the end face of the wall 5, and a transverse portion 9 that may be coaxial with the longitudinal axis 2 of the tube.

The other side of the portion 8 of the flare 7 is attached to an end surface 10 of a ceramic balance ring 11 in a like fashion. The ceramic balance ring is coaxial with the wall 5. The other end surface 12 of the balance ring 11 is located in a recess 13 in the mounting plate 3.

The recess 13 also includes an end portion 14 of a second flare 15, the other end portion 16 of which is welded to the transverse portion 9 of the other flare 7.

The inclusion of the ceramic balance 11 ring helps to relieve thermal stresses in the assembly as the temperature of the tube 1 changes during operation. However, it has been found that, in certain circumstances where the temperature difference experienced by the tube is greater than usual, thermally-induced mechanical stress can become unacceptably high.

Figure 2:
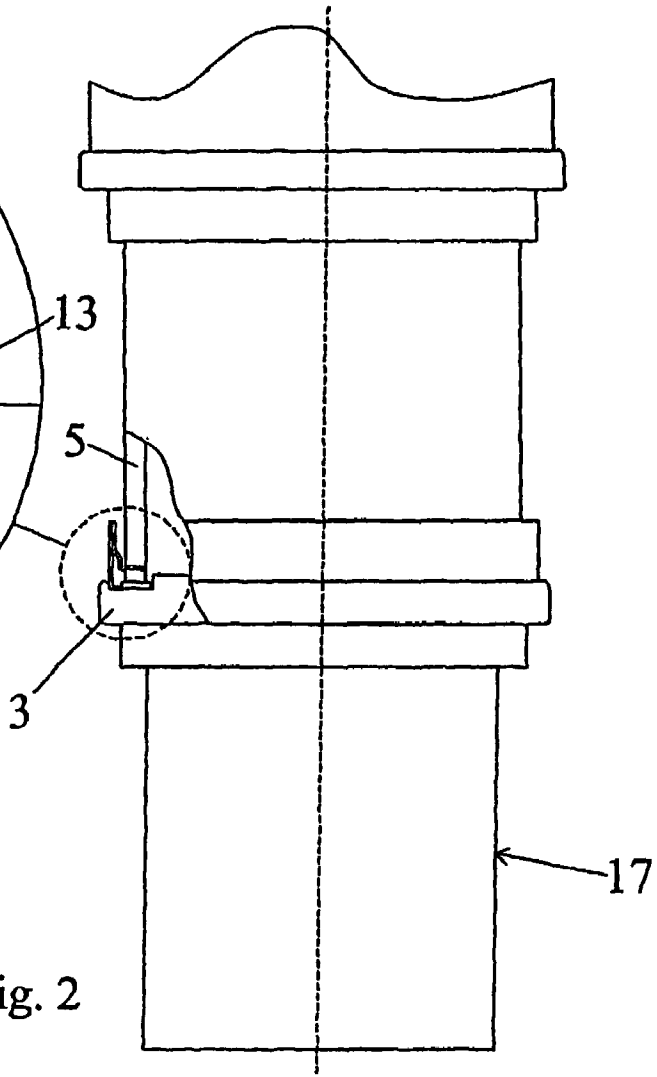
FIG. 2: is a partly sectional side view of an electron beam tube constructed according to the invention.
Figure 2A:
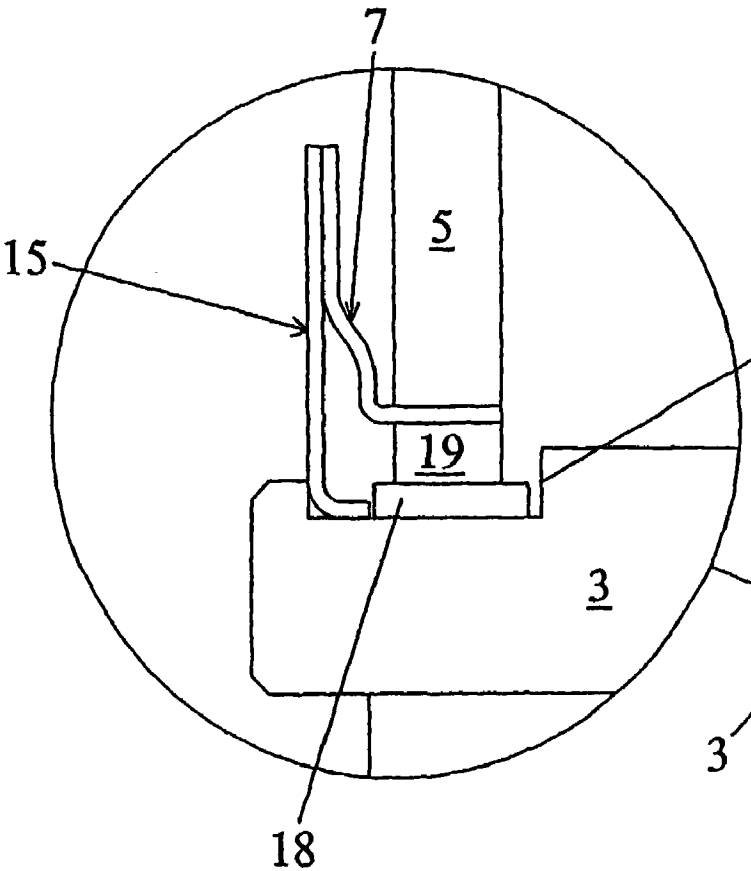
FIG. 2*a:* illustrates in more detail the portion of FIG. 2 circled by a broken line.

A tube constructed in accordance with the invention is illustrated in FIGS. 2 and 2*a,* and is indicated generally by the reference numeral 17 (see FIG. 2). This tube also comprises a cylindrical wall 5, attached to the mounting plate 3 of a drift tube assembly via the intermediary of a balance ring and flares 7, 15 as shown in FIG. 2*a.*

However, in accordance with the invention, the tube 17 further comprises means, such as member 18, (see FIG. 2*a*), arranged to allow small radial movement of the balance ring with respect to the mounting plate, in order to alleviate thermal stresses on the tube.

In this arrangement, the member 18 is annular and is substantially coaxial with the cylindrical wall 5. The member is interposed between a balance ring 19 (see FIG. 2*a*) and the mounting plate 3. The member 18 is located in the recess 13 of the mounting plate and is held in location by atmospheric forces acting upon the tube when the interior has been evacuated to produce a vacuum, as shown in FIG. 2*a.*

The member 18 comprises material arranged to provide reduced friction between the balance ring 19 and the mounting plate 3. Preferably, the member has a lower coefficient of friction than both the balance ring and the mounting plate.

Alternatively, a member coated with or loaded with friction-reducing material may be provided. As a further alternative, a layer of friction-reducing material may be substituted for the member 18. A plurality of friction-reducing members may be provided between the balance ring and the mounting plate.

This means arranged to allow radial movement of the balance ring with respect to the drift tube assembly may alternatively, or additionally, be interposed between other components of the tube, in order to further reduce stress experienced overall by the tube assembly. The invention has particular merits when the means is interposed between components having different coefficients of thermal expansion.

A tube assembly typically comprises a plurality of ceramic walls alternating with metallic structures, such as a plurality of drift tube assemblies. Therefore, a plurality of members 18, for example, may be located between each ceramic and metallic component to provide relative redial movement of those components.

The invention permits the balance ring to move radially in order to alleviate the forces caused by differential thermal expansion of components of the tube. The member moves in a sliding motion, thereby maintaining the integrity of the vacuum envelope. Thus, a tube constructed according to the invention can be operated under substantially more onerous conditions than were feasible hitherto.

The invention is particularly applicable to arrangements in which the balance ring is of ceramic and the mounting plate or electrode is a hard metal such as nickel. In such circumstances, the ceramic balance ring can bind on the surface, which can cause stresses and cracking. The use of the member as described allowing the balance ring to slide overcomes this problem.

The invention claimed is:

1. An electron beam tube having a longitudinal axis and comprising a wall forming part of a vacuum envelope, a balance ring, a mounting component and a member interposed between the balance ring and the mounting component, the member having a lower coefficient of friction than both the balance ring and the mounting component, whereby the member is arranged to allow relative sliding movement between the balance ring and the mounting component in a radial direction.

2. A tube as claimed in claim 1, in which the wall comprises ceramic material.

3. A tube as claimed in claim 1, in which the member comprises an annulus.

4. An electron beam tube according to claim 1, wherein the balance ring comprises ceramic material.

5. An electron beam tube according to claim 1, wherein the mounting component comprises a mounting plate.

6. An electron beam tube according to claim 5, wherein the mounting plate comprises of copper, stainless steel, or nickel material.

7. An electron beam tube of the type having a longitudinal axis and a radial axis and a radial axis and a comprising a wall, a balance ring and a mounting component, the wall comprising part of a vacuum envelope and being coupled to the mounting component by the balance ring in the direction of the longitudinal axis, the electron beam tube further comprising a member interposed between the balance ring and the mounting component to allow relative sliding movement between the balance ring and the mounting component in a direction parallel to the radial axis, the member having a lower coefficient of friction than both the balance ring and the mounting component.

8. An electron beam tube according to claim 7, wherein the member comprises a layer of friction reducing material.

9. An electron beam tube according to claim 7, wherein the member is coated with friction-reducing material.

10. An electron beam tube according to claim 7, wherein the balance ring comprises ceramic material.

11. An electron beam tube according to claim 7, wherein the mounting component is a mounting plate.

12. An electron beam tube according to claim 11, wherein the mounting plate is of copper, stainless steel or nickel.

* * * * *